United States Patent [19]

Wood

[11] Patent Number: 4,568,139

[45] Date of Patent: Feb. 4, 1986

[54] LATERALLY ENGAGED ELECTRICAL CONNECTOR

[75] Inventor: Theodore H. Wood, Bridgewater, Mass.

[73] Assignee: Alden Research Foundation, Brockton, Mass.

[21] Appl. No.: 680,139

[22] Filed: Dec. 10, 1984

[51] Int. Cl.[4] ..... H01R 13/15

[52] U.S. Cl. ..... 339/255 R

[58] Field of Search ..... 339/255 R, 255 B, 262 R, 339/262 P

[56] References Cited

U.S. PATENT DOCUMENTS 4,508,405 4/1985 Damon ..... 339/255 R

FOREIGN PATENT DOCUMENTS 215494 9/1941 Switzerland ..... 339/255 R 813559 3/1981 U.S.S.R. ..... 339/255 R

*Primary Examiner*—Joseph H. McGlynn

*Attorney, Agent, or Firm*—James H. Grover

[57] ABSTRACT

Electrical paper processing apparatus includes an electrical connector device arranged to make a sliding connection with an electrical contact on a paper magazine which is moved laterally toward the electrical contact or other than forwardly as with a push-in type of plug connector. The electrical connector device is on a housing having an insulative base wall and cover. Extending from the base wall is a post adapted to position a conductive terminal at its foot. A conductive cap with a rounded end and a flanged end telescopes over the post, the rounded end passing through an opening in the cover. A spring compressed between the terminal and the cap yieldingly urges the flange against the inside of the cover so that the cap can retract as the magazine is inserted in paper processing apparatus laterally of the direction in which the cap moves, the spring pressing the cap laterally of the magazine against a corresponding electrical contact when the magazine is fully inserted in the apparatus.

9 Claims, 5 Drawing Figures

LATERALLY ENGAGED ELECTRICAL CONNECTOR

BACKGROUND OF THE INVENTION

This invention involves a connector device for use in paper processing apparatus such as office copiers, developers and printers, wherein the paper is supplied to the processor in a magazine inserted into a pocket or compartment in the processor. More particularly the insertable magazine includes one or more means for pretreating the paper preparatory to further processing in the apparatus, for example preheating, applying an electrostatic charge or erasing such a charge. A pretreating magazine requires electrical power supplied through one or more contacts on the magazine and corresponding connectors leading to power supplies in the main frame of apparatus. Such a magazine also will include, in addition to a supply of paper sheets, rolls for feeding the sheets out to the processor and has considerable bulk which requires tolerance in the compartment receiving the magazine in a sliding movement approaching the connectors in the compartment.

The objects of the present invention are to provide a connector to a magazine which accommodates the sliding apporach of the magazine, makes a firm, positive connection with contacts on the magazine, which adjusts to a large tolerance in the dimensions of the magazine and the compartment receiving it, and which is inexpensive to manufacture and assembly.

SUMMARY OF THE INVENTION

According to the invention an electrical connector device in apparatus slidingly receiving a paper magazine with one or more electrical contacts comprises a base with a wall of insulating material having a post extending therefrom; a conductive terminal at the foot of the post; a conductive cap having a rounded end and a flanged end telescoping over the post; a spring around the post compressed between the cap and the terminal; and an insulative cover attached to the base with an opening passing the rounded end of the cap outside the cover, the cover engaging and confining the cap and spring on the post in electrically conductive connection to the terminal; whereby the magazine may be moved laterally along the cover over the cap to a position electrically engaging the cap.

DRAWING

Figure 2:
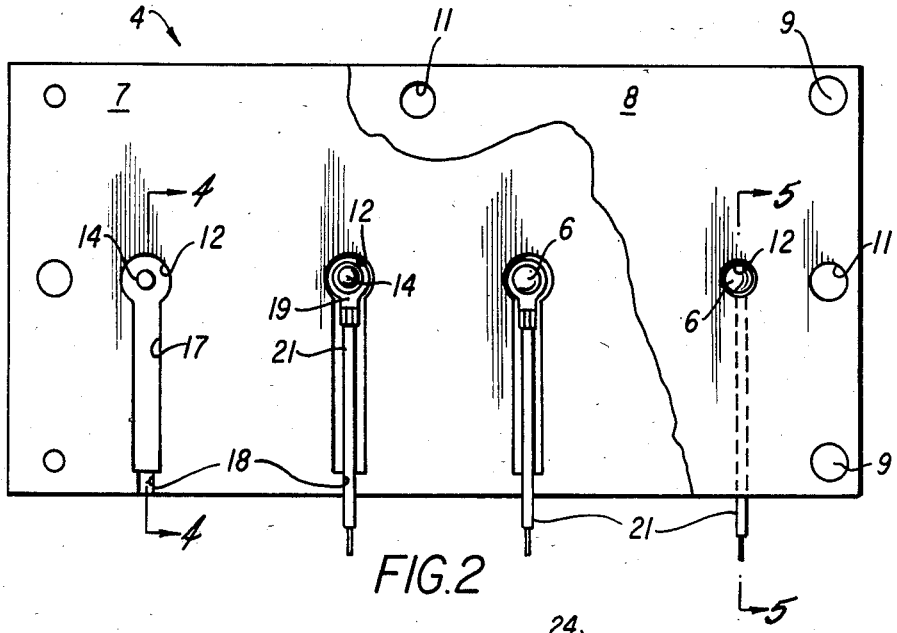
FIG. 2 is a plan view of an electrical connector device according to the invention, partly broken away.
Figure 4:
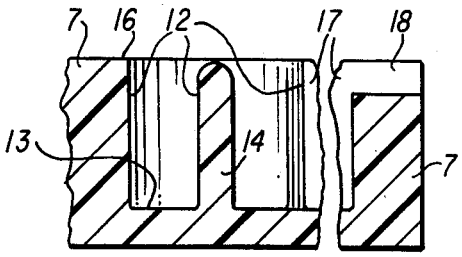
Figure 5:
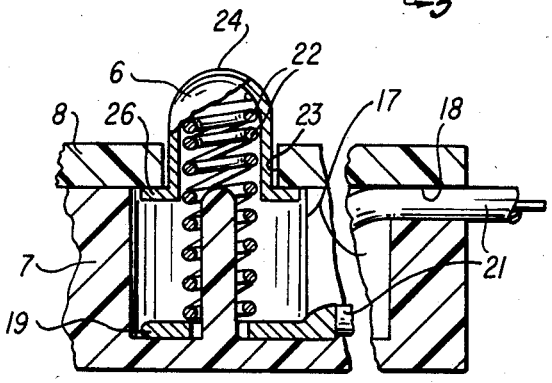

FIGS. 4 and 5 are sections on lines 4—4 and 5—5 of FIG. 2.

DESCRIPTION

Figure 1:
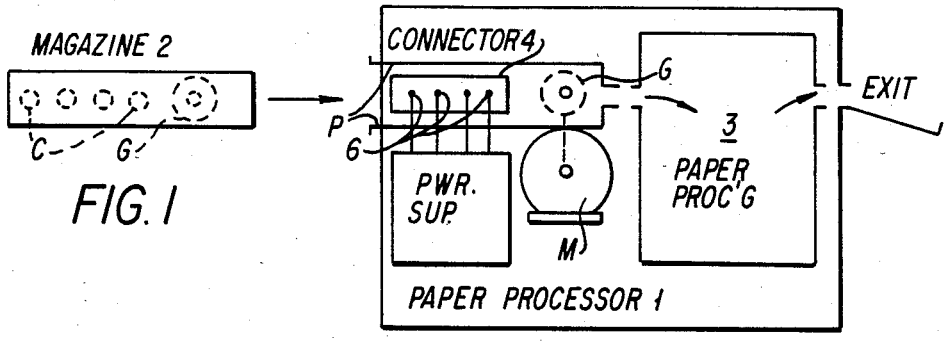
FIG. 1 is a schematic showing of paper processing apparatus.
Figure 3:
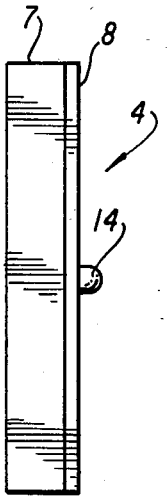
FIG. 3 is an end view of the device.

An example of apparatus in which the present connector device is used, as shown in FIG. 1, comprises a paper processor 1 having a pocket or compartment P slidingly receiving a magazine 2 holding a supply of paper sheets and containing electrical paper pretreating means connected to contacts C on the back side of the magazine as shown in FIG. 1. The magazine has also a gear wheel G adapted to mesh with a like gear G driven by a motor M in the processor 1 for feeding paper from the magazine through paper processing stages 3 to an exit. The magazine 2 is slid into the compartment laterally riding over the connector device 4 of the present invention until the magazine contacts C mate with corresponding connector caps 6 of the connector device. Insertion of the magazine involves sliding of the magazine case latarally toward and over the connector caps from varying angles dependent on the accuracy of manual insertion, the required tolerance in compartment dimensions to allow for variations in the angle of insertion and the dimensions of the magazine.

The connector device 4 itself, shown in FIGS. 2 to 5, comprises a base 7 to which a cover 8 is attached by suitable fasteners 9. Both base and cover preferably are a rigid insulative plastic such as polypropylene. Openings 11 through the cover and base allow attachment of the device in the processor. As shown in FIG. 4 the base 7 has cylindrical cavities 12 with a circular bottom 13 from which a concentric post 14 extends to the plane surface 16 of the base. A channel 17 extends from each cavity through a constriction 18 to the exterior of the base 7.

The post 14 in each cavity serves several purposes as shown in FIG. 5. First, it receives a conductive eyelet or ring terminal 19 clinched to an insulated lead wire 21 and positions the terminal centrally and axially in the base cavity 12, anchoring the lead wire.

Secondly, the post locates a phosphor bronze coiled, compression spring 22 around and coaxially of the post.

Thirdly, the post guides sliding, reciprocal movement axially of the post by the spring 22 and a conductive, beryllium copper cap 6 shown also in FIG. 1. Each conductive cap 6 passes through an opening 23 in the cover 8 and extends outside the cover at least the extent of its rounded end 24 which is hemispheroidal, a curved surface of revolution presenting a camming surface in all directions of the sliding approach of the magazine. The cap 6 and spring 22 are held compressed against the wire terminal 19 by the cover 8.

It should be understood that the present disclosure is for the purpose of illustration only and that this invention includes all modifications and equivalents which fall within the scope of the appended claims.

I claim:

1. In electrical paper processing apparatus slidingly receiving a paper magazine having an electrical contact, an electrical connector device comprising:

a base with a wall of insulating material having a post extending therefrom;

a conductive terminal at the foot of the post;

a conductive cap having a rounded end and a flanged end telescoping over the post;

a spring around the post compressed between the cap and the terminal; and an insulative cover attached to the base with an opening passing the rounded end of the cap outside the cover, the cover engaging and confining the cap and spring on the post is electrically conductive connection to the terminal;

whereby the magazine may be moved laterally along the cover over the cap to a position electrically engaging the cap.

2. A connector device according to claim 1 wherein the rounded end of the cap is a curved surface of revolution outside the cover presenting a camming surface to a magazine slid laterally toward the cap.

3. A connector device according to claim 1 wherein the post is integrally molded with the base.

4. A connector device according to claim 1 wherein the terminal is an eyelet connected to an electrical lead wire, the post receiving the eyelet in conducting relation to the spring and anchoring the eyelet and lead wire.

5. A connector device according to claim 1 wherein the cap is hollow and telescopes over the spring.

6. A connector device according to claim 5 wherein the post positions the spring and guides reciprocation of the spring and cap.

7. A connector device according to claim 1 wherein the post positions the spring and guides reciprocation of the spring and cap.

8. A connector device according to claim 7 wherein the terminal is an eyelet connected to an electrical lead wire, the post receiving the eyelet in conducting relation to the spring and anchoring the eyelet and lead wire.

9. A connector device according to claim 8 wherein the cap is hollow and telescopes over the spring.

* * * * *

UNITED STATES PATENT AND TRADEMARK OFFICE

CERTIFICATE OF CORRECTION

PATENT NO. 4,568,139

DATED February 4, 1986

INVENTOR(S) Theodore H. Wood

It is certified that error appears in the above-identified patent and that said Letters Patent are hereby corrected as shown below:

Claim 1, line 58, change "is" to -- in --.

Signed and Sealed this

*Thirteenth* Day of *May 1986*

[SEAL]

*Attest:*

DONALD J. QUIGG

*Attesting Officer*

*Commissioner of Patents and Trademarks*